US008677637B2

(12) United States Patent
Willis

(10) Patent No.: US 8,677,637 B2
(45) Date of Patent: Mar. 25, 2014

(54) ARCHERY SIGHTING METHOD AND APPARATUS

(76) Inventor: Mikel Landry Willis, DeRidder, LA (US)

( * ) Notice: Subject to any disclaimer, the term of this patent is extended or adjusted under 35 U.S.C. 154(b) by 111 days.

(21) Appl. No.: 13/355,058

(22) Filed: Jan. 20, 2012

(65) Prior Publication Data

US 2012/0186089 A1 Jul. 26, 2012

Related U.S. Application Data

(60) Provisional application No. 61/435,084, filed on Jan. 21, 2011.

(51) Int. Cl.
*F41G 1/467* (2006.01)

(52) U.S. Cl.
USPC ..... 33/265; 124/87

(58) Field of Classification Search
USPC ..... 33/265; 124/87
See application file for complete search history.

(56) References Cited

U.S. PATENT DOCUMENTS

| | | | | |
|---|---|---|---|---|
| 7,290,345 | B2 * | 11/2007 | Ellig | 33/265 |
| 7,392,590 | B2 * | 7/2008 | Gordon | 33/265 |
| 7,603,784 | B2 * | 10/2009 | Erhard | 33/265 |
| 8,151,473 | B2 * | 4/2012 | Sims et al. | 33/265 |
| 8,186,068 | B2 * | 5/2012 | Pulkrabek et al. | 33/265 |
| 8,356,416 | B1 * | 1/2013 | Johnson | 33/265 |
| 2005/0138824 | A1 * | 6/2005 | Afshari | 33/265 |
| 2008/0222904 | A1 * | 9/2008 | Erhard | 33/265 |
| 2008/0235962 | A1 * | 10/2008 | Sims et al. | 33/265 |
| 2011/0167654 | A1 * | 7/2011 | Pulkrabek et al. | 33/228 |
| 2012/0102767 | A1 * | 5/2012 | Pulkrabek et al. | 33/228 |
| 2012/0186089 | A1 * | 7/2012 | Willis | 33/265 |
| 2012/0255187 | A1 * | 10/2012 | Sims et al. | 33/265 |

* cited by examiner

*Primary Examiner* — Yaritza Guadalupe-McCall
(74) *Attorney, Agent, or Firm* — Ted M. Anthony

(57) ABSTRACT

An archery sight assembly for aiming bows including, without limitation, compound bows. An adjustable mounting bracket connects the archery sight assembly to a bow and permits position adjustment of a sight window relative to the bow. At least two rigid optical sight pins are visible through the sight window. A length of fiber optic cable extends from the tip of a first optical sight pin, through a transparent housing, and attaches to the tip of a second optical sight pin. The optical sight pins have an offset angle to provide a gap between the pins, thereby improving the archer's field of vision.

4 Claims, 5 Drawing Sheets

ARCHERY SIGHTING METHOD AND APPARATUS

CROSS REFERENCES TO RELATED APPLICATION

Priority of U.S. Provisional Patent Application Ser. No. 61/435,084, filed Jan. 21, 2011, Incorporated Herein by Reference, is hereby claimed.

STATEMENTS AS TO THE RIGHTS TO THE INVENTION MADE UNDER FEDERALLY SPONSORED RESEARCH AND DEVELOPMENT

None

BACKGROUND OF THE INVENTION

1. Field of the Invention

The present invention pertains to archery sights. More particularly, the present invention pertains to archery sights employing fiber optic technology. More particularly still, the present invention pertains to an archery sight having versatile and durable pins that support fiber optic cables.

2. Brief Description of the Prior Art

Bows can be shot without using a sight for aiming. However, as technology improves and bows become more powerful, shooting without a sight has become increasingly challenging, especially at longer ranges. As such, archery sights have become much more common in recent years. Modern bows, and particularly compound bows, are typically equipped with some type of bow sight.

Much like a sight at the end of a gun barrel, a bow sight helps an archer aim arrows shot from a bow. Generally, bow sights work by providing feedback regarding where a projectile (arrow) is pointed. Although bow sights have many different configurations, bow sights are typically mounted on bow risers.

Archery sights come in a number of different configurations and levels of sophistication. One very common type of sight is known as a "fixed pin" sight. Fixed-pin sights typically have a plurality of individual pins, which can each be set to correspond with a particular known distance. Once set, the pins are secured or locked into place and remain "fixed" in position during use. Such fixed pin sights are generally very reliable and easy-to-use, even in the field.

Archers typically set their fixed pins to correspond to distances that are easy to remember, usually in 5 or 10 yard increments. Once the pins are set, shooting known distances is relatively easy. However, archers using fixed-pin sights frequently must learn to compensate for intermediate distances for which no pin is set. For example, if a target is 45 yards away, a 40 yard pin will aim too low while a 50 yard pin will aim too high. As a result, archers using fixed-pin sights must learn to "split the difference" between the pins using a practice commonly referred to as "gap-shooting".

Archery sights typically employ fiber optic strands/cables to improve the aiming process. Fiber optic cables typically comprise a strand of optically pure glass or plastic surrounded by cladding. The cladding reflects light into the core of the cable. Thus, when the fiber optic cable is exposed to sunlight (or any other light source), light travels to the end of the cable where the core is exposed. In this manner, the end tip of the cable appears to "light-up", as if energized by an external power source. Generally, the longer the fiber-optic cable, the more light it can gather and the brighter the tip becomes.

The small bright tip of a fiber optic cable makes an excellent aiming point on an archery sight. Even in low light conditions (for example, early in the morning or late in the evening), the tip of the fiber optic cable still stands out, thereby allowing the archer to effectively aim using the sight even in such low-light conditions.

As more pins are mounted in an archery sight, such pins can be set for smaller yardage increments, thereby reducing the need for gap shooting. However, when numerous pins are mounted in a sight, more of the target can be obscured behind such pins. This situation can make aiming more difficult, especially for certain bows with small pin-gaps.

Thus, there is a need for an improved archery sight that permits the use of multiple pins without blocking the view of an archer or otherwise obscuring the target behind such pins. The pins should be strong and durable, while permitting quick and efficient position adjustment.

SUMMARY OF THE PRESENT INVENTION

The present invention comprises an archery sight having at least one fiber optic sight pin, as well as a method for using same. An archer can utilize the method and apparatus of the present invention to set pre-determined distances which the archer can then use to aim a bow, such as a compound bow or the like.

In the preferred embodiment, the optical sight pins of the present invention can be beneficially manufactured using a metal injection molding ("MIM") process known to those having skill in the art. In the preferred embodiment, the optical sight pins of the present invention are constructed of stainless steel; said optical sight pins of the present invention are not machined from aluminum made of plastic like conventional prior art sight pins.

Each individual optical sight pin of the present invention comprises a substantially square mounting block on one end, said block having a threaded bore. A socket head cap screw and washers can be used to fasten or secure each optical sight pin in elongate slots in a sight window which, in turn, forms part of a bow sight. Each sight pin is slideably disposed within a slot and can be locked in place in a desired location.

Each optical sight pin of the present invention includes at least one eyelet on the back of such pin. Said at least one eyelet is located on the optic sight pin for maximum holding strength of a fiber optic cable attached to such optical sight pin. In the preferred embodiment, each eyelet on each optical sight pin has a diameter of no larger than 0.031" and no smaller than 0.012", to permit use of different size fiber optic cables within said eyelets. The fiber optic cable is then threaded through the eyelets and fastened on one end for viewing by the archer.

In the preferred embodiment, the optical sight pins of the present invention comprise blade style or shaped sight pins. In the preferred embodiment, each optic sight pin is also designed and built with a beneficial twelve (12) degree offset angle which gives each pin strength that greatly exceeds conventional prior art sight pins. The design and shape of the optical sight pins of the present invention result in a sight pin pattern in the sight window of the bow sight that does not obscure or block the target from view.

Dimensions set forth herein and in the attached drawings and/or photographs are illustrative only and are not intended to be, and should not be construed as, limiting in any way.

BRIEF DESCRIPTION OF THE DRAWINGS

The foregoing summary, as well as the following detailed description of the preferred embodiments, is better understood when read in conjunction with the appended drawings. For the purpose of illustrating the invention, the drawings show certain preferred embodiments. It is understood, however, that the invention is not limited to the specific methods and devices disclosed. Further, dimensions, materials and part names are provided for illustration purposes only and not limitation.

DETAILED DESCRIPTION OF A PREFERRED EMBODIMENT OF THE INVENTION

Figure 1:
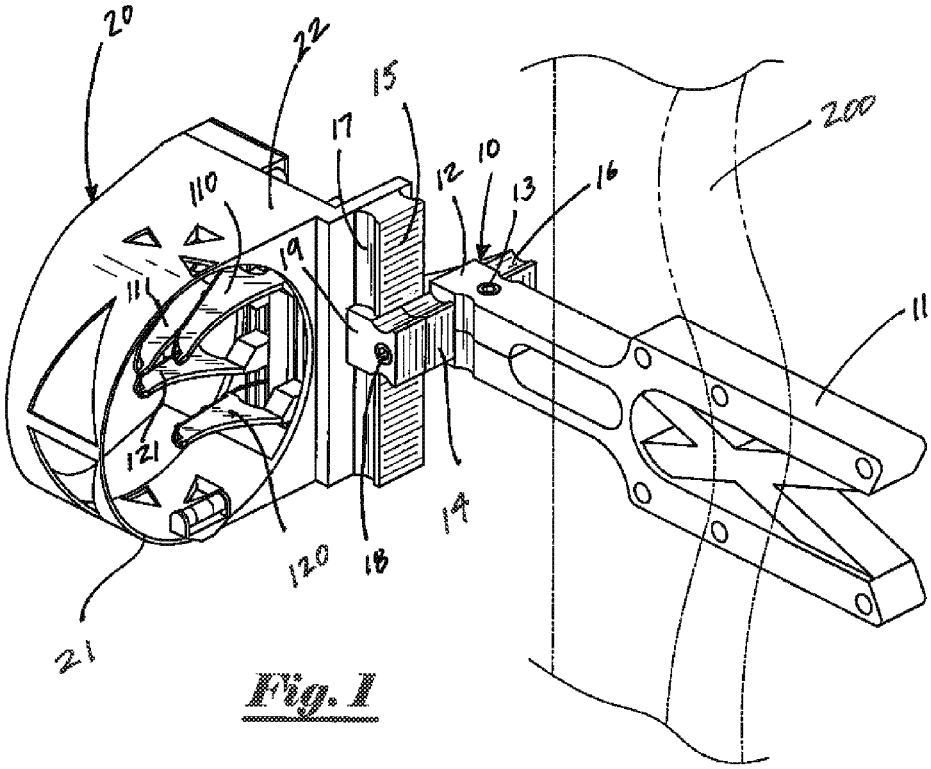
FIG. 1 depicts a side perspective view of an archery sight assembly of the present invention.

Referring to the drawings, FIG. 1 depicts a side perspective view of archery sight assembly 100. Archery sight assembly 100 can be mounted to a bow, such as compound bow 200, using adjustable bow mounting bracket assembly 10. Said adjustable bow mounting bracket assembly 10 comprises mounting arm 11 that can be attached to compound bow 200. In the preferred embodiment, the longitudinal axis of mounting arm 11 is oriented substantially perpendicular to the longitudinal axis of compound bow 200.

Mounting arm 11 has end clamp member 12 which can be selectively tightened or loosened using set screw 13. Said end clamp member 12 is utilized to connect mounting arm 11 to horizontal bracket member 16, which is slideably received within said end clamp member 12. Horizontal bracket member 16 has scaled surface 14, and adjustable end piece 19. Adjustable end piece 19 is attached to horizontal bracket member 16 and can be tightened or loosened using set screw 18. Vertical bracket member 17, having scaled surface 15, is slideably received in a gap formed between end piece 19 and horizontal bracket member 16, and is secured in place when set screw 18 is tightened. It is to be observed that said horizontal bracket member can also be configured as a single piece rather than separate pieces 16 and 19 as depicted in the figures.

Still referring to FIG. 1, sight assembly 20 is affixed to adjustable mounting bracket assembly 10. Sight assembly 20 comprises sight frame 22 that defines sight window 21 having a central opening viewable by an archer. Optical sight pins 110 and 120 are disposed within sight window 21 and are at least partially visible through said opening. Adjustment of horizontal bracket member 16 and vertical bracket member 17 permit horizontal and vertical adjustment of sight window 21 (as well as optical sight pins 110 and 120) relative to compound bow 200.

Figure 2:
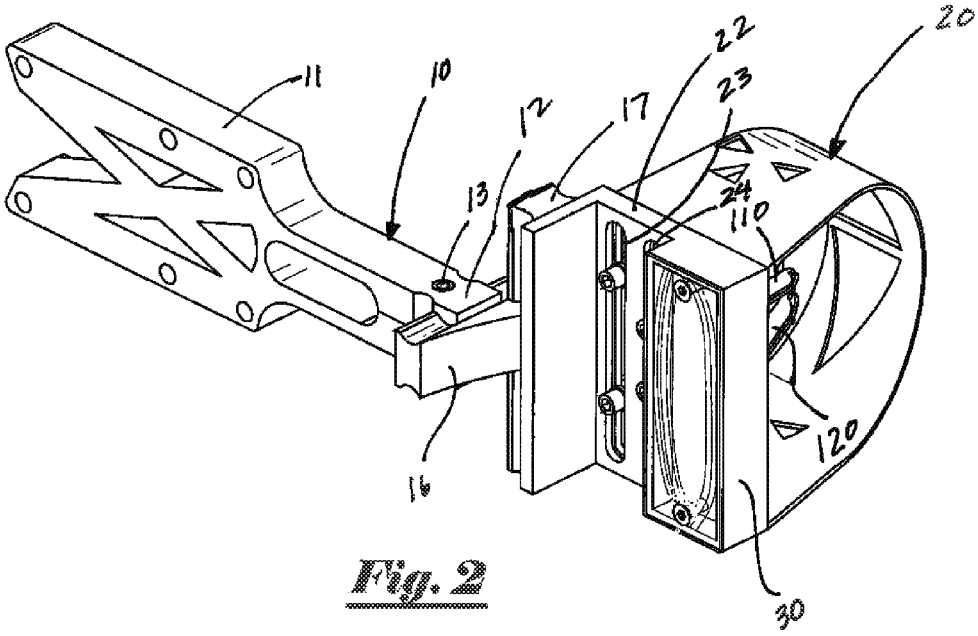
FIG. 2 depicts a side perspective view of an archery sight assembly of the present invention.

FIG. 2 depicts a side perspective view of archery sight assembly 100 from the opposite side as the view depicted in FIG. 1. Mounting arm 11 has end clamp member 12 which can be selectively tightened or loosened using set screw 13. Said end clamp member 12 is utilized to adjustably connect mounting arm 11 to horizontal bracket member 16, which is in turn adjustably attached to vertical bracket member 17. Sight assembly 20 is affixed to adjustable mounting bracket assembly 10. Sight assembly 20 comprises sight frame 22 that defines sight window 21 having an opening. Optical sight pins 110 and 120 are disposed within sight window 21, and can be selectively moved within elongate pin adjustment slots 23 and 24. Substantially transparent fiber optic cable housing 30 is attached to sight frame 22.

Figure 3:
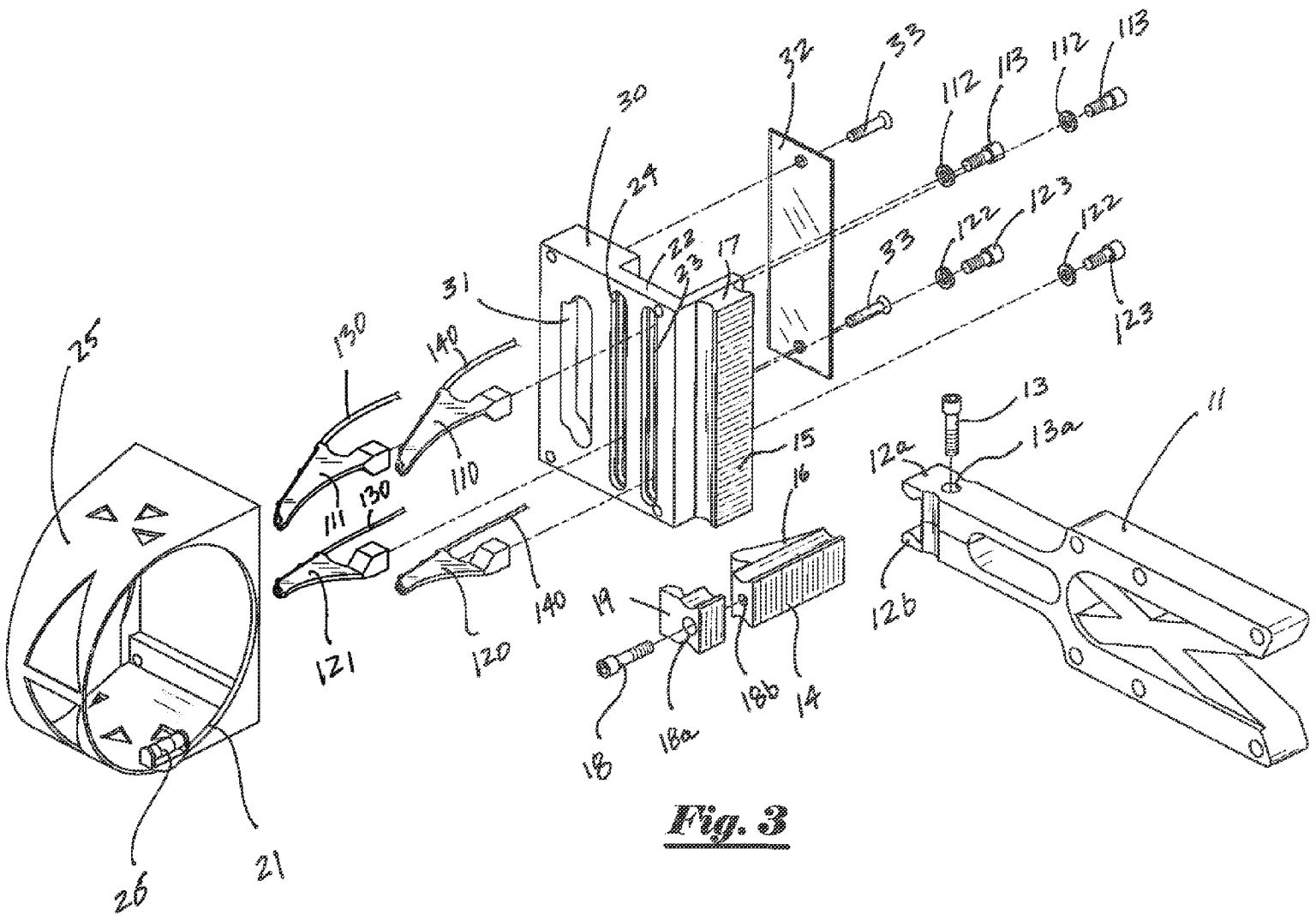
FIG. 3 depicts an exploded view of an archery sight assembly of the present invention.

FIG. 3 depicts an exploded view of archery sight assembly 100 of the present invention. Adjustable bow mounting bracket assembly 10 comprises mounting arm 11 that can be attached to a bow, such as compound bow 200 depicted in FIG. 1. Mounting arm 11 has end clamp member 12 comprising upper clamp member 12*a* and lower clamp member 12*b*. Said upper clamp member 12*a* and lower clamp member 12*b* can be selectively tightened or loosened using set screw 13 which is received within threaded bore 13*a*.

Horizontal bracket member 16 is slideably received between clamp members 12*a* and 12*b*. Horizontal bracket member 16 has scaled surface 14 having reference marks, and adjustable end piece 19. Vertical bracket member 17 has scaled surface 15 having reference marks, and is slideably received in a gap formed between end piece 19 and horizontal bracket member 16.

Sight frame 22 is attached to vertical bracket member 17. Sight frame 22 has elongate sight pin adjustment slots 23 and 24. In the preferred embodiment, said elongate sight pin adjustment slots 23 and 24 are oriented substantially vertically and parallel to each other. Substantially transparent fiber optic cable housing 30 having opening 31 is attached to sight frame 22. Substantially transparent cover panel 32 can attach to fiber optic cable housing 30 using anchor screws 33.

Downward optical sight pin 110 is slideably disposed within elongate vertical slot 23, while downward optical sight pin 111 is slideably disposed within elongate vertical slot 24. Said optical sight pins can be selectively anchored in place using washers 112 and screws 113. Similarly, upward optical sight pin 120 is slideably disposed within elongate vertical slot 23, while upward optical sight pin 121 is slideably disposed within elongate vertical slot 24. Said optical sight pins can be anchored in place using washers 122 and screws 123. Fiber optic cable 130 has a first end affixed to optical sight pin 111 and a second end affixed to optical sight pin 121. Similarly, fiber optic cable 140 has a first end affixed to optical sight pin 110 and a second end affixed to optical sight pin 120.

Sight window housing 25, which is attached to sight frame 22, defines substantially circular sight window 21 having an opening. In the preferred embodiment, bubble level 26 is attached to sight window housing 25. Upward optical sight pins 120 and 121 and downward optical sight pins 110 and 111 are at least partially visible through the opening in sight window 21.

Figure 4:
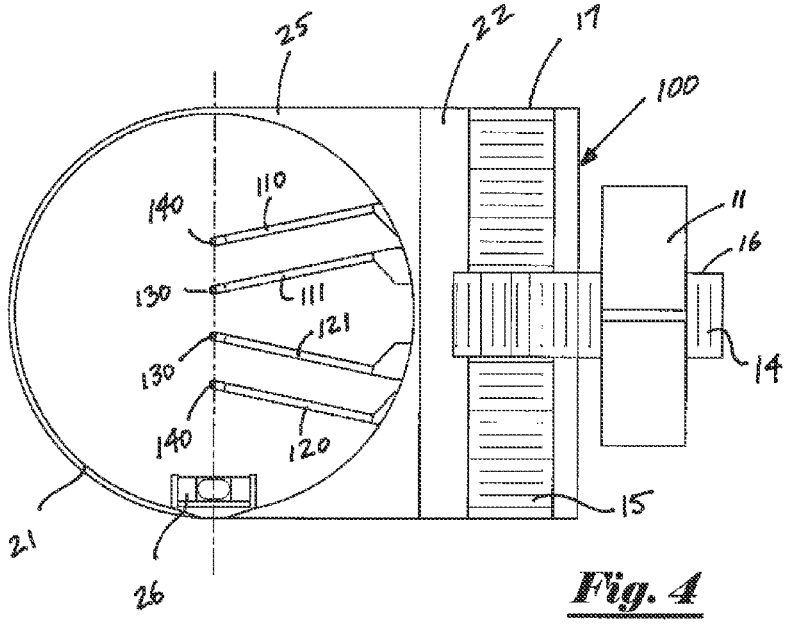
FIG. 4 depicts a side view of an archery sight assembly of the present invention through the sight window of said archery sight.

FIG. 4 depicts a side view of archery sight assembly 100 of the present invention through sight window 21. Adjustable bow mounting bracket assembly 10 comprises mounting arm 11 that can be attached to a bow, such as compound bow 200 depicted in FIG. 1. Mounting arm 11 is adjustably attached to horizontal bracket member 16 having scaled surface 14 with reference marks. Horizontal bracket member 16 is adjustably connected to vertical bracket member 17 which has scaled surface 15 having reference marks. Sight bracket 22 is connected to vertical bracket member 17.

Sight window housing 25, which defines substantially circular sight window 21 having an opening, is attached to sight frame 22. Downward optical sight pins 110 and 111, and upward optical sight pins 120 and 121, are at least partially visible within sight window 21. One end of fiber optic cable 130 is affixed to optical sight pin 111, while the other end of fiber optic cable 130 is affixed to optical sight pin 121. Similarly, one end of fiber optic cable 140 is affixed to optical sight pin 110, while the second end of fiber optic cable 140 is affixed to optical sight pin 120. In the preferred embodiment of the present invention, said ends of fiber optic cables 130 and 140 (as well as the tips of sight pins 110, 111, 120 and 121) are positioned substantially along the vertical centerline of sight window 21. Bubble level 26 is attached to sight window housing 25.

Figure 5:
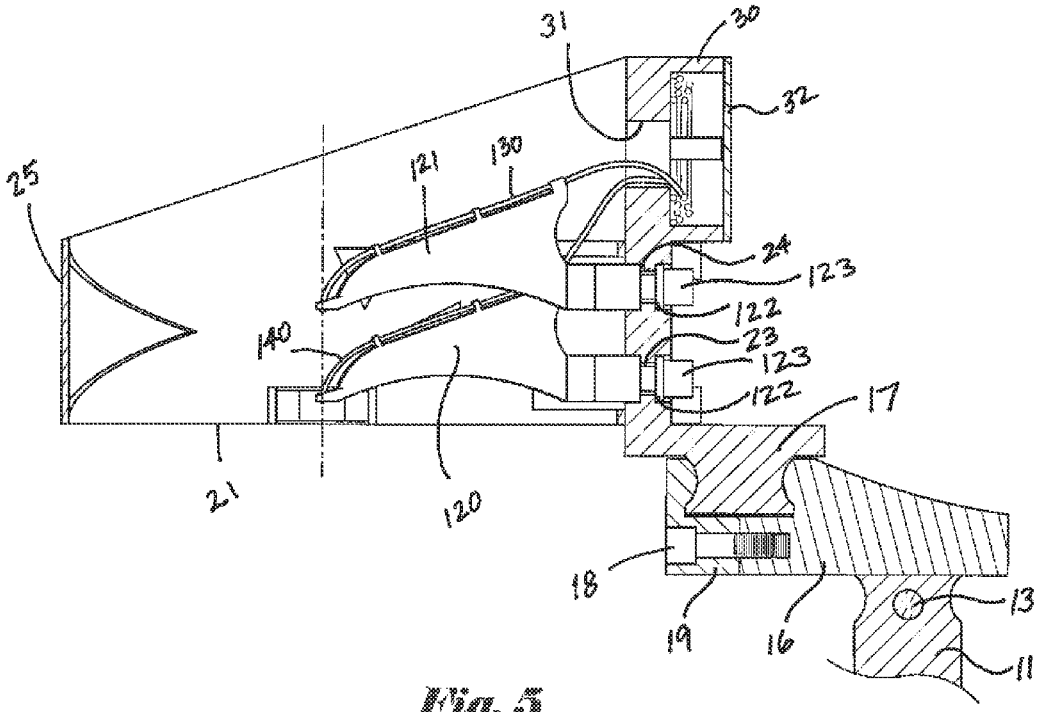
FIG. 5 depicts an overhead sectional view of an archery sight assembly of the present invention.

FIG. 5 depicts an overhead sectional view of an archery sight assembly 100 of the present invention. Mounting arm 11 is adjustably connected to horizontal bracket member 16, and can be selectively tightened or loosened using set screw 13. End piece 19 is attached to horizontal bracket member 16 using set screw 18. Vertical bracket member 17 is slideably received in a gap formed between end piece 19 and horizontal bracket member 16.

Sight frame 22 is attached to vertical bracket member 17. Sight frame 22 has elongate and substantially parallel sight pin adjustment slots 23 and 24. Substantially transparent fiber optic cable housing 30 having opening 31 is attached to sight frame 22. Substantially transparent cover panel 32 is attached to and can cover fiber optic cable housing 30.

Sight window housing 25, which is attached to sight frame 22, defines substantially circular sight window 21. Bubble level 26 is attached to sight window housing 25. Upward optical sight pin 120 is slideably disposed within elongate vertical slot 23, while upward optical sight pin 121 is slideably disposed within elongate vertical slot 24. Said optical sight pins can be anchored in place using washers 122 and screws 123. Fiber optic cable 130 has an end affixed to optical sight pin 121, while fiber optic cable 140 has an end affixed to optical sight pin 120. In the preferred embodiment, said fiber optic cables 130 and 140 are colored differently from each other, and extend into substantially transparent fiber optic cable housing 30 where they are wrapped in a spool-like configuration. Substantially transparent housing 30 allows fiber optic cables 130 and 140 to be exposed to light. Although not depicted in FIG. 5, the opposite ends of fiber optic cables 130 and 140 emerge from fiber optic cable housing 30 through opening 31 and connect to downward sight pins 111 and 110, respectively.

Figure 6:
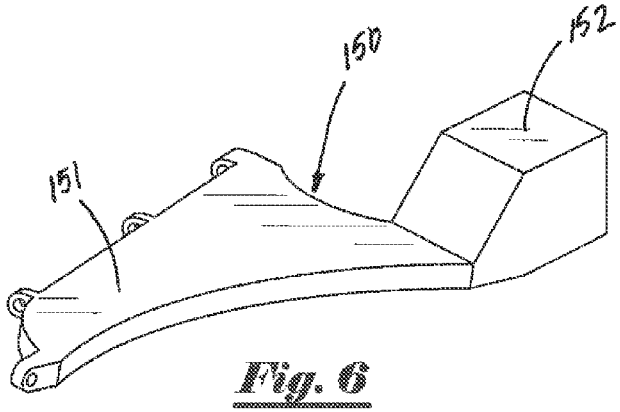
FIG. 6 depicts a side perspective view of an upward sight pin of the present invention.
Figure 7:
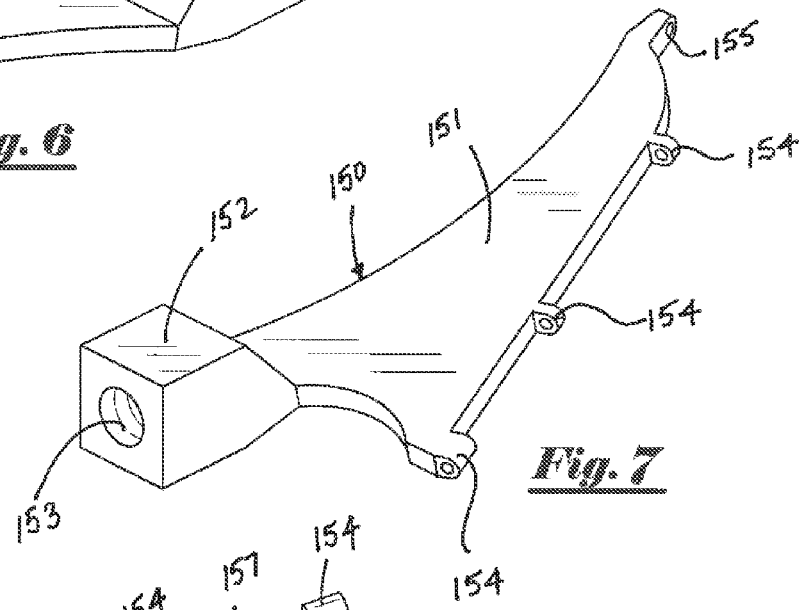
FIG. 7 depicts a side perspective view of an upward sight pin of the present invention.

FIG. 6 depicts a side perspective view of upward optical sight pin 150 of the present invention, which is identical to upward sight pins 120 and 121 described previously and depicted in FIGS. 1-5. In the preferred embodiment, upward sight pin 150 embodies a "blade-style" or shaped pin having substantially planar section 151. Mounting block 152 is attached to one end of said planar section 151. Referring to FIG. 7, in the preferred embodiment said mounting block 152 has threaded bore 153. Said mounting block 152 can be disposed within an elongate vertical slot in a sight assembly (such as elongate vertical slot 23 depicted in FIG. 5) and anchored in place using a threaded screw received within said threaded bore 153 (such as screws 123 depicted in FIG. 5).

Still referring to FIG. 7, optical sight pin 150 includes a plurality of eyelets 154 disposed on one edge of said optic sight pin 150. Said eyelets 154 are beneficially located at positions on optical sight pin 150 for maximum holding strength of a fiber optic cable. In the preferred embodiment, eyelets 154 each have the same hole diameter, which is beneficially in the range of 0.012" to 0.031" to accommodate the diameter of the particular fiber optic cables being used. A fiber optic cable can be threaded through said eyelets and fastened to end eyelet 155 for viewing by an archer in the manner described above.

Figure 8:
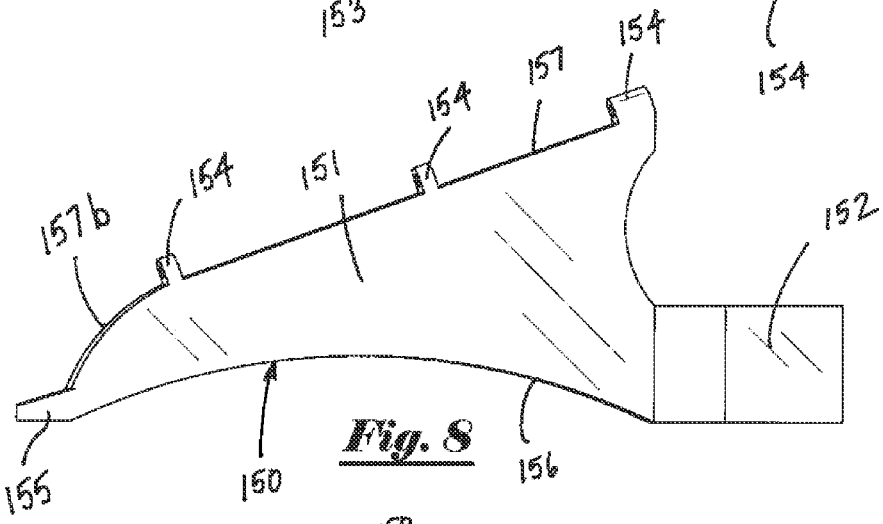
FIG. 8 depicts a side view of an upward sight pin of the present invention.

FIG. 8 depicts a side view of upward sight pin 150 of the present invention having substantially planar section 151 and mounting block 152. In the preferred embodiment, planar section 151 defines front edge 156 and back edge 157. A plurality of eyelets 154 are disposed along back edge 157, with end eyelet 155 disposed at the distal end or tip of said planar section 151. As shown in FIG. 8, front edge 156, which faces an archer when said optic sight pin 150 is in use, has a curved, substantially concave shape. Back edge 157 is substantially straight along section 157*a*, and then forms gentle curved section 157*b* culminating at end eyelet 155. The radius of curvature of curved section 157*b* is beneficially designed to ensure that a fiber optic cable disposed through eyelets 154 and end eyelet 155 is not damaged from severe bending or kinking.

Figure 9:
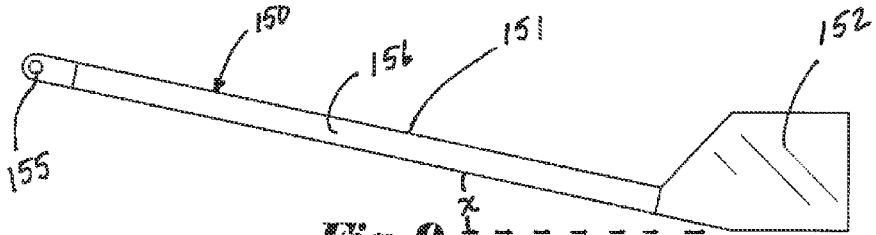
FIG. 9 depicts a side view of an upward sight pin of the present invention.

FIG. 9 depicts a side view of upward sight pin 150 of the present invention along front edge 156. Upward sight pin 150 of the present invention has substantially planar section 151, mounting block 152 and end eyelet 155 disposed at the opposite end of substantially planar section 151 from mounting block 152. The longitudinal axis of bore 153 is not oriented parallel to the longitudinal axis of substantially planar section 156; rather upward optical sight pin 150 defines offset angle "x" between planar section 151 and mounting block 152. In the preferred embodiment, said angle is in the range of 10°-20°, and is beneficially set at 12° degrees; however, it is to be observed that other angles can be employed that will yield satisfactory results.

Figure 10:
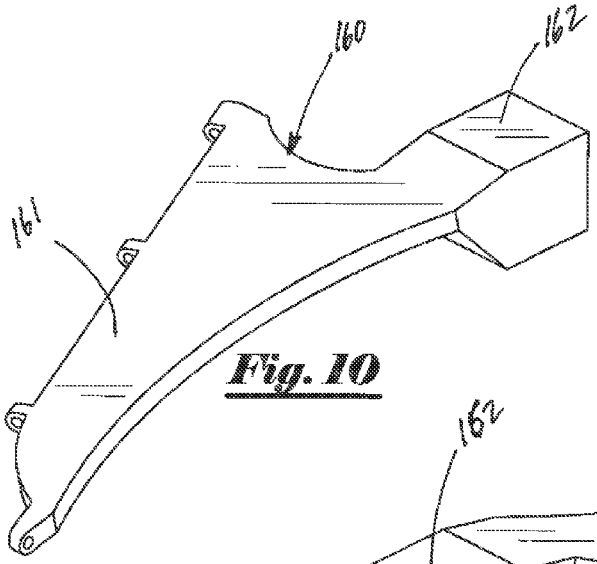
FIG. 10 depicts a side perspective view of a downward sight pin of the present invention.
Figure 11:
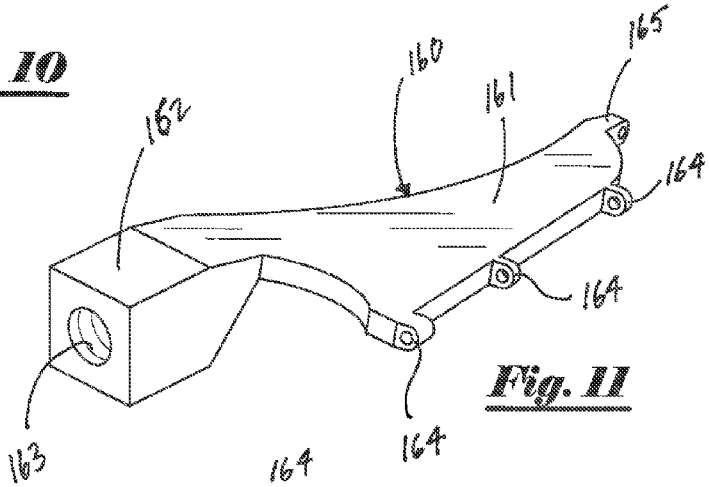
FIG. 11 depicts a side perspective view of a downward sight pin of the present invention.

FIG. 10 depicts a side perspective view of downward sight pin 160 of the present invention, which is identical to downward sight pins 110 and 111 described previously and depicted in FIGS. 1-5. In the preferred embodiment, downward sight pin 160 embodies a "blade-style" or shaped pin having substantially planar section 161. Mounting block 162 is attached to one end of said substantially planar section 161. Referring to FIG. 11, in the preferred embodiment said mounting block 162 has threaded bore 163. Said mounting block 162 can be disposed within an elongate vertical slot in a sight assembly (such as elongate vertical slot 23 depicted in FIG. 5) and anchored in place using a threaded screw received within said threaded bore 163 (such as screws 123 depicted in FIG. 5).

Still referring to FIG. 11, optic sight pin 160 includes a plurality of eyelets 164 disposed on one side of said optic sight pin 160. Said eyelets 164 are beneficially located at positions on optic sight pin 160 for maximum holding strength of a fiber optic cable. In the preferred embodiment, eyelets 164 each have the same hole diameter, which is beneficially in the range of 0.012" to 0.031" to accommodate the diameter of the particular fiber optic cables being used. A fiber optic cable can be threaded through said eyelets and fastened to end eyelet 165 for viewing by an archer.

Figure 12:
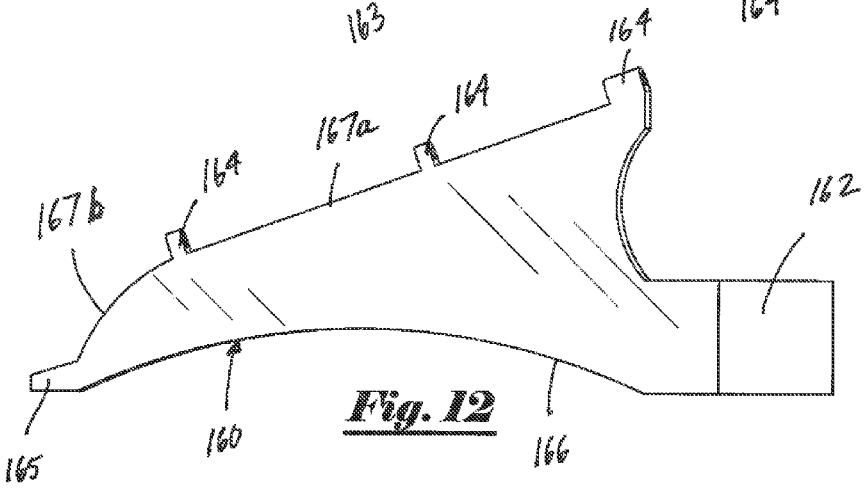
FIG. 12 depicts a side view of a downward sight pin of the present invention.

FIG. 12 depicts a side view of downward sight pin 160 of the present invention having substantially planar section 161 and mounting block 162. In the preferred embodiment, planar section 161 defines front edge 166 and back edge 167. A plurality of eyelets 164 are disposed along back edge 167, with end eyelet 165 disposed at the end tip of said planar section 161. As shown in FIG. 12, front edge 166, which faces an archer when said optic sight pin 160 is in use, has a curved, substantially concave shape. Back edge 167 is substantially straight along section 167*a*, and then forms gentle curved section 167*b* culminating at end eyelet 165. The radius of curvature of curved section 167*b* is beneficially designed to ensure that a fiber optic cable disposed through eyelets 164 and end eyelet 165 is not damaged from severe bending or kinking.

Figure 13:
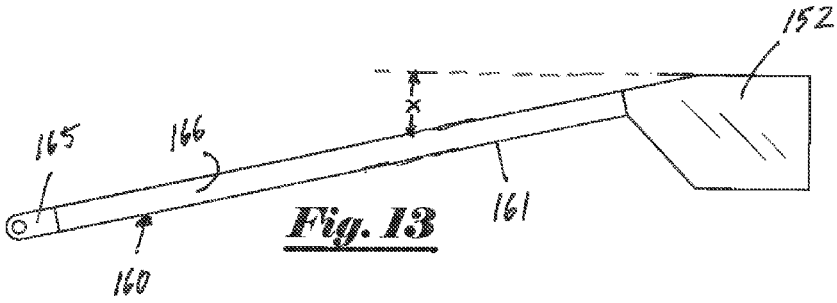
FIG. 13 depicts a side view of a downward sight pin of the present invention.

FIG. 13 depicts a side view of downward sight pin 160 of the present invention along front edge 166. Downward sight pin 160 of the present invention has substantially planar section 161, mounting block 162 and end eyelet 165 disposed at the opposite end of substantially planar section 161 from mounting block 162. Downward optic sight pin 160 defines offset angle "x" which is typically in the range between 10°-20°. In the preferred embodiment, said angle is set at 12° degrees; however, it is to be observed that other angles can be employed that will yield satisfactory results.

In the preferred embodiment, the optical sight pins of the present invention (including, for example, upward optical sight pin 150 and downward optical sight pin 160) are beneficially constructed of 17-4 stainless steel using a Metal Injection Molding ("MIM") manufacturing process that is known to those having skill in the art. Said optical sight pins of the present invention are not machined from aluminum like conventional prior art pins. Dimensions set forth herein and in the attached figures illustrative only and are not intended to be, and should not be construed as, limiting in any way.

In operation, an archer can use archery sight assembly 100 of the present invention to improve aim and accuracy when shooting a bow such as, for example, a compound bow. Referring to FIG. 4, an archer can connect mounting arm 11 to a bow, and adjust sight window 21 to a desired position relative to said bow. Once said sight window is set, the archer can set optical sight pins 110, 111, 121 and 120 to correspond to pre-determined distances (such as, for example, in 5 or 10 yard increments).

When fiber optic strands or cables 130 and 140 are exposed to sunlight (or any other light source), light travels to the end tips of such cables. In this manner, the tips of cables 130 and 140 "light-up" at the ends of optical sight pins 110, 111, 121 and 120. The small bright tips of the fiber optic cables make excellent aiming points for an archer looking through the opening of sight windows 21 of archery sight assembly 100.

Because of the cooperating offset angles of downward optical sight pins 110 and 111, and upward optical sight pins 121 and 120, a gap is formed between said pins near the bases of said optical sight pins. The gap formed by cooperating optical sight pins of archery sight assembly 100 of the present invention provides for an improved field of vision compared to conventional archery sights that employ straight sight pins. Said straight sight pins can block or obscure an archer's field of vision, frequently preventing a clear view of a target.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. An optical sight pin for use in a bow sight comprising:

(i) a base having a bore, wherein said bore has a longitudinal axis; and (ii) a substantially planar body section connected to said base, said substantially planar body section having a first edge defining a substantially concave shape, a second edge defining a substantially convex shape, a width, a longitudinal axis and at least one eyelet disposed along said second edge, wherein the longitudinal axis of said bore and said substantially planar body section are not parallel with each other, and an angle formed between the longitudinal axis of said bore and the longitudinal axis of said substantially planar body section is in a range between 10 and 20 degrees.

2. The optical sight pin of claim 1, wherein said angle is 12 degrees.

3. The optical sight pin of claim 1, wherein said optical sight pin is constructed of stainless steel.

4. The optical sight pin of claim 1, wherein said optical sight pin is manufactured using a metal injection molding process.

* * * * *